US006872084B2

(12) United States Patent
Naito et al.

(10) Patent No.: US 6,872,084 B2
(45) Date of Patent: Mar. 29, 2005

(54) ELECTRICAL CONNECTOR ASSEMBLY

(75) Inventors: Takaki Naito, Kanagawa (JP); Doron Lapidot, Tokyo (JP)

(73) Assignee: Tyco Electronics AMP, K.K., Kanagawa (JP)

( * ) Notice: Subject to any disclaimer, the term of this patent is extended or adjusted under 35 U.S.C. 154(b) by 0 days.

(21) Appl. No.: 09/819,107

(22) Filed: Mar. 28, 2001

(65) Prior Publication Data

US 2001/0027041 A1 Oct. 4, 2001

(30) Foreign Application Priority Data

Mar. 31, 2000 (JP) ..... 2000-097618

(51) Int. Cl.[7] ..... H01R 4/66; H01R 13/648
(52) U.S. Cl. ..... 439/108; 439/941
(58) Field of Search ..... 439/108, 607, 439/98, 610, 660, 941, 608

(56) References Cited

U.S. PATENT DOCUMENTS 4,582,386 A * 4/1986 Martens ..... 439/101
4,680,557 A * 7/1987 Compton ..... 439/108
4,707,671 A * 11/1987 Suzuki et al. ..... 174/36
4,850,887 A * 7/1989 Sugawara ..... 439/108
5,145,387 A * 9/1992 Ishihashi ..... 439/108
5,163,835 A * 11/1992 Morlion ..... 439/108
5,205,762 A * 4/1993 Carney ..... 439/108
5,725,386 A * 3/1998 Davis et al. ..... 439/607
5,764,489 A * 6/1998 Leigh et al. ..... 439/108
6,217,378 B1 * 4/2001 Wu ..... 439/607
6,224,420 B1 * 5/2001 Nishio et al. ..... 439/607

FOREIGN PATENT DOCUMENTS

JP 1-150379 10/1989 ..... H01R/13/193

* cited by examiner

*Primary Examiner*—Gary Paumen
*Assistant Examiner*—Felix O. Figueroa

(57) ABSTRACT

An electrical connector assembly in which conductor pads on a board are used as contacts is described. Signal conductor pads transmitting positive and negative differential signals, are disposed on one side of the board. A ground pad is disposed on the opposite side of the board so that it is positioned at an intermediate point between the positive and negative signal conductor pads, thus forming one set of pads. The signal conductor pads of another adjacent set, are disposed on the same side as the signal pad of the previous set such that their negative differential signals an adjacent. The pad of a third set (not shown in the figures) which is adjacent to the positive signal pad of the second set is a pad that transmits the same positive differential signal. As a result, signal crosstalk can be prevented.

6 Claims, 7 Drawing Sheets

PRIOR ART

ELECTRICAL CONNECTOR ASSEMBLY

FIELD OF THE INVENTION

The present invention relates to an electrical connector assembly. More specifically the invention is directed to an electrical connector assembly for high-speed signal transmission which is used for high-speed digital image transmission between such devices as liquid crystal monitors and personal computer main bodies (or multi-media relay boxes), or copying machines and servers, etc.

BACKGROUND OF THE INVENTION

It is known in the prior art to have electrical connectors with contacts positioned on either side of an insulating member. As one example, the contact mechanism of a male connector disclosed in Japanese Utility Model Application Kokai No. HEI 1-150379 is shown in FIG. 13. In this male connector 200, a plurality of conductor patterns or traces are disposed at specified intervals on both sides of the plate-form insulating body 202, and are formed as contacts 204 of the male connector 200. These contacts 204 are arranged so that the contacts 204 on the respective sides of the insulating body are oriented in opposite directions from each other. The, contacts 204 make electrical contact with mating contacts 206 when the male connector 200 is engaged with a mating connector (not shown in the figures).

In this type of conventional male connector, no consideration is given to crosstalk between the transmission channels formed by the conductor patterns. Accordingly, the transmitted signals are easily affected by such crosstalk. Furthermore, in cases where some of these conductive patterns are used for power transmission, the likelihood of noise or crosstalk affecting the signals is greatly increased.

Consequently, it would be advantageous to provide an electrical connector assembly which prevents crosstalk, and which is suitable for high-speed transmission. It would also be beneficial to provide an electrical connector assembly which is inexpensive, and in which impedance matching is easy.

SUMMARY OF THE INVENTION

The electrical connector assembly of the present invention is equipped with a housing, a planar insulating body which is held in the housing, a plurality of conductor pads that are formed on both sides of the insulating body, and cables which are connected to the conductor pads. The cables each have a positive signal line and a negative signal line used for differential transmission and a ground line. The positive signal line and negative signal line of each cable are connected to adjacent conductor pads on one side of the insulating body, while the ground line is connected to a conductor pad on the other side of the insulating body which is located in an intermediate position between the adjacent conductor pads to which the positive signal line and negative signal line are connected. The conductor pads are disposed so that a respective conductor pad to which the positive signal line or negative signal line of each cable is connected is located in closest proximity to a conductor pad to which a signal line of the same phase of another adjacent cable is connected. Accordingly, adjacent conductor pads are arranged so that signal lines of the same phase are in close proximity to each other, thus preventing [the signal lines] from affecting each other in electrical terms. Consequently, there is no blunting of the rise of the signals, and the connector is suitable for high-speed transmission. Furthermore, crosstalk can be prevented. Since the contacts are formed by conductor pads, the width of the conductor pads and the spacing between adjacent conductor pads can be formed with high precision; accordingly, optimal impedance matching is possible.

The electrical connector assembly of the present invention may be constructed so that power supply conductor pads are disposed to the outside of the rows of the signal conductor pads provided on the insulating body. In this case, it is desirable that the conductor pads used for the power supply ground connection be disposed on the side of the signal conductor pads, and that the conductor pads on the side of active lines be disposed to the outside of the conductor pads used for ground connection. Additionally, it is desirable that the power supply conductor pads be disposed on both sides of the rows of signal conductor pads. Furthermore, in a case where the electrical connector assembly of the present invention is constructed so that power supply conductor pads are disposed to the outside of the rows of signal conductor pads disposed on the insulating body, the power supply, which tends to be a source of noise, can be separated from the signal transmission paths, so that signal noise can be reduced; furthermore, the diffusion of heat from the contacts can be efficiently accomplished.

DETAILED DESCRIPTION OF THE INVENTION

Figure 1:
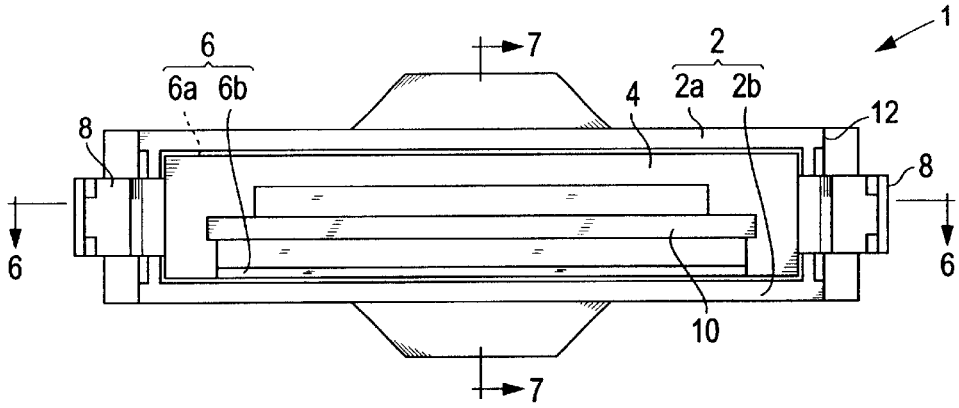
FIG. 1 is a front view of the electrical connector assembly of the present invention.
Figure 2:
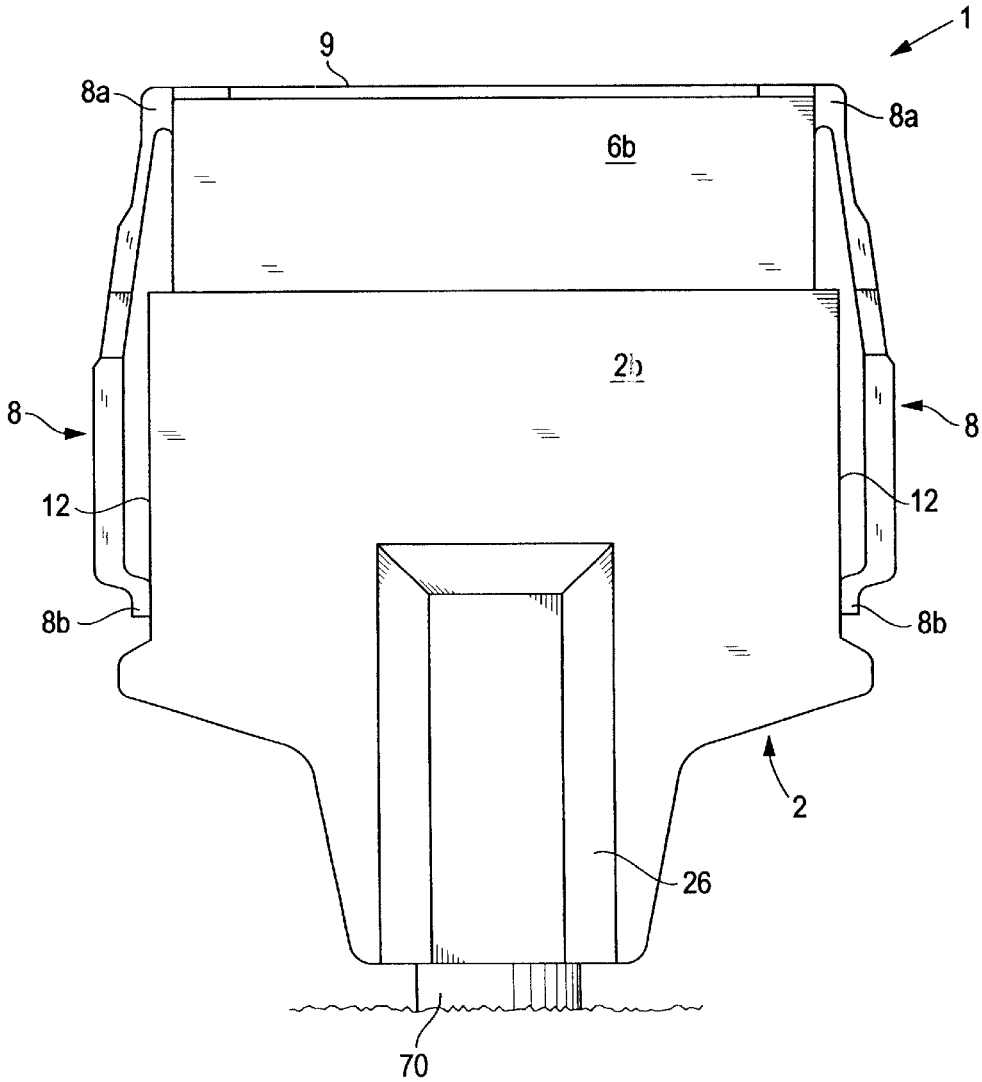
FIG. 2 is a bottom view of the electrical connector assembly shown in FIG. 1.
Figure 3:
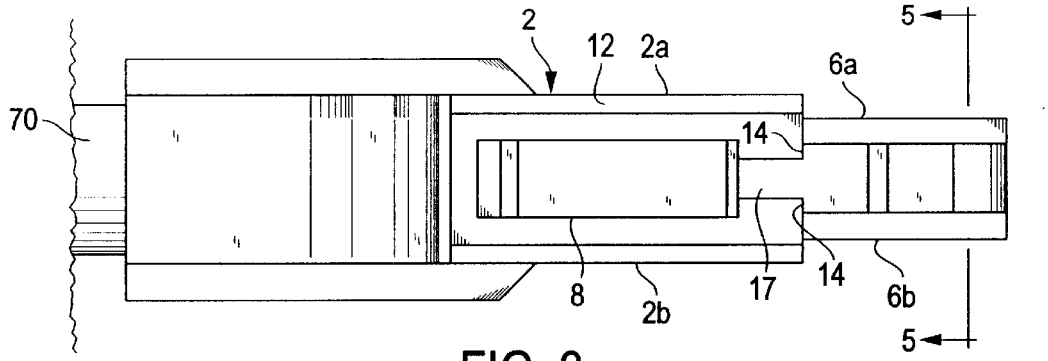
FIG. 3 is a side view of the electrical connector assembly shown in FIG. 1.

Referring to FIG. 1, a connector 1 has a resin cover member 2 that narrows at the back (as is shown in FIG. 2). A metal shielding shell 6 is positioned inside this cover member 2. The cover member 2 has two cover member half bodies 2*a* and 2*b*, and the shell 6 has two shell half bodies 6*a* and 6*b*. A housing, i.e., a board holder (hereafter referred to simply as a "holder") 4 which has a pair of integrally attached latch arms 8 installed inside the shell 6. The holder 4 holds an insulating board (planar or plate-form insulating body) 10 inside. As best shown in FIG. 2, the board 10 is disposed roughly in the center of an engaging part 9 along the direction of length of the engaging part 9. As is shown most clearly in FIGS. 2 and 3, the shell 6 is covered by the cover member 2 such that the front part, i.e., the side of the engaging part 9 of the connector 1, is exposed.

As best shown in FIG. 2, the latch arms 8 are formed as cantilever parts which extend rearward at an inclination and which have fixed ends 8*a* on the side surfaces of the front end portion of the holder 4. The free ends 8*b* of the latch arms 8 are bent toward the sides surfaces 12 of the cover member 2, and are positioned so that they can slide over the side surfaces 12. As is shown most clearly in FIG. 3, narrow parts 16 which are formed roughly in the center of each latch arm 8 with respect to the direction of length. Rearward-facing facing engaging shoulders 14 are formed on the latch arms 8 and extend from the narrow parts 17. The engaging shoulders 14 engage with the mating connector 100 (described later, see FIG. 10) when the connector 1 is engaged with the mating electrical connector 100, such that the engaging shoulders 14 and mating connector 100 are anchored to each other. Although the embodiment shown has the latch arms extending from the side surfaces of the holder, the latch arms may also be installed on the upper surface and/or undersurface of the holder 4.

A protruding part 26, which extends rearward along the axial line from roughly the center of the cover member 2, is formed in the cover member 2. A cable 70 is accommodated in the protruding part. Details of the attachment relationship between the holder 4 and board 10 will be described later.

Figure 4:
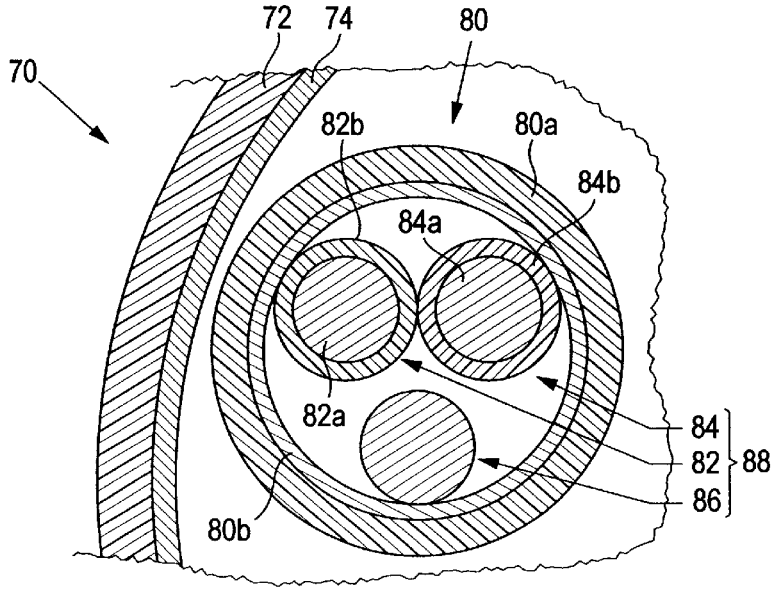
FIG. 4 is a sectional view of the cable.

Referring to FIG. 4, the cable 70 for use with connector 1 is shown in cross section. The cable 70 has an insulating outer covering 72, a braided wire 74 functioning as a ground conductor which covers the inside of the outer covering 72, and a plurality of small-diameter cables 80 which are located inside this braided wire 74. Only a portion of the cable 70 is shown in FIG. 4, as more than one cable 80 is generally provided. The small-diameter cables 80 are generally cables of the type known as "shielded twisted bare cables", which are suitable for high-speed digital differential transmission. As is clear from FIG. 4, each of these small-diameter cables 80 has an insulating outer covering 80*a*, an aluminum foil or ground conductor 80*b* that covers the inside surface of this outer covering 80*a*, and three types of electrical wires 88 that are located inside this aluminum foil 80*b*. The electrical wires 88 consist of a positive signal line 82, a negative signal line 84 and a ground line 86. The three electrical wires 88 are twisted together and positioned inside the aluminum foil 80*b* of the small-diameter cable 80. The positive signal line 82 and negative signal line 84 respectively have signal conductors 82*a* and 84*a*, and insulating outer coverings 82*b* and 84*b* that cover these signal conductors 82*a* and 84*a*. The ground line 86 is a bare electrical wire which contacts the aluminum foil 80*b*.

Figure 5:
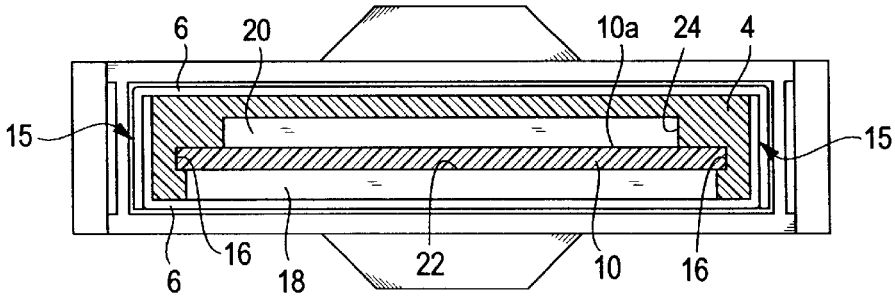
FIG. 5 is a sectional view along line 5—5 in FIG. 3.
Figure 6:
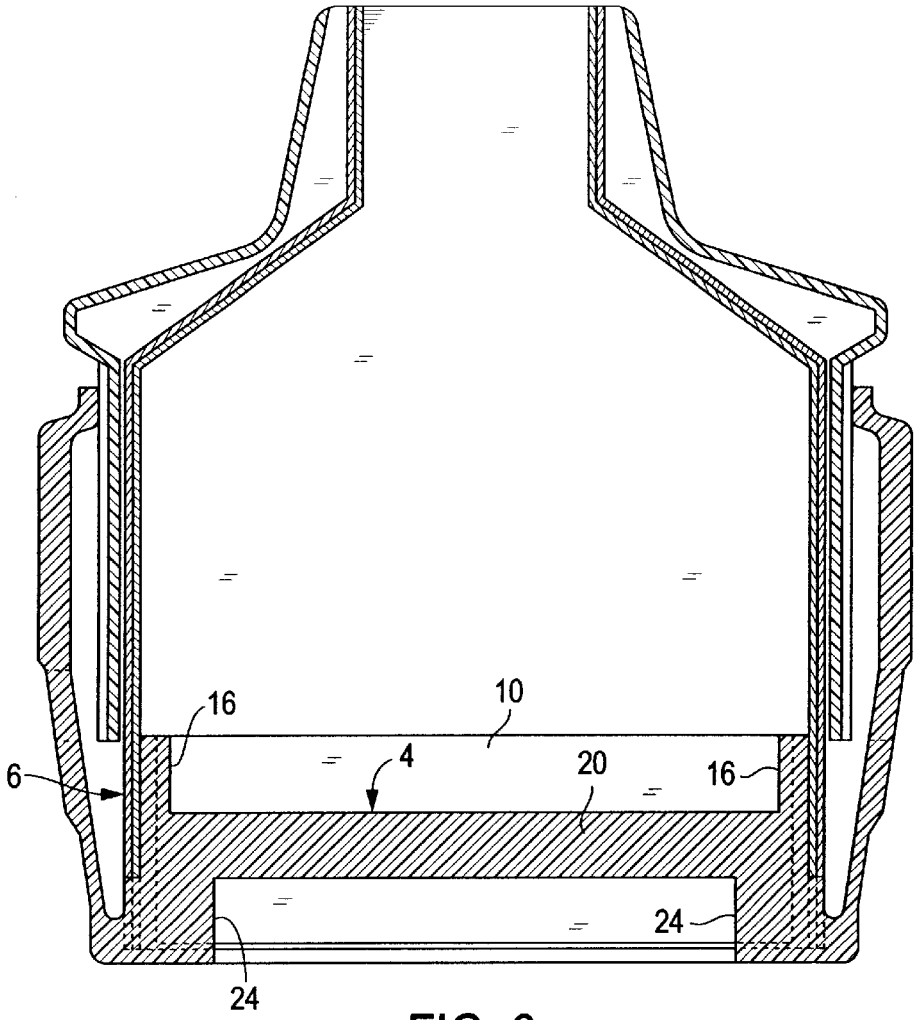
FIG. 6 is a sectional view along line 6—6 in FIG. 1.
Figure 7:
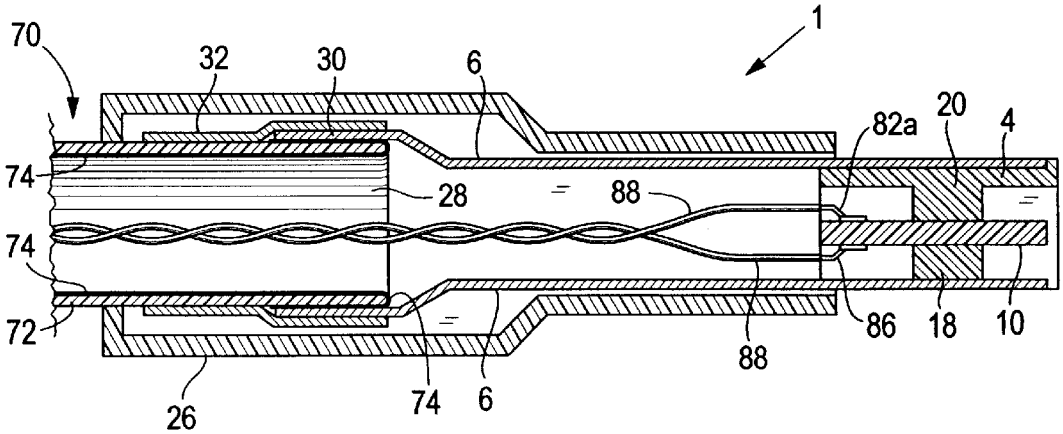
FIG. 7 is a sectional view along line 7—7 in FIG. 1.

As shown in FIGS. 5 through 7 the shell half bodies 6*a* and 6*b* are arranged so that their side walls 15 overlap each other, and are anchored to each other by any of a number of universally known mechanisms, such as interlocking engagement or latching engagement, etc. As the holder is positioned between the shell half bodies, the holder 4 is also held inside the shell 6 when the shell half bodies are anchored together. Guide grooves 16 which accommodate the board 10 are formed in both sides of the holder 4. Supporting parts 18 and 20 which extend along the direction of length of the holder 4 (i.e., the left-right direction in FIG. 5) are formed in the central portion of the holder 4. The space between the supporting parts 18 and 20 forms a board passage 22 into which the board is inserted. Furthermore, projections 24 which contact the upper surface 10*a* of the board 10 are formed on both sides of the upper portion of the front end part of the holder 4. When the board 10 is supported by the holder 4, roughly the central portion of the board 10 is supported in the holder 4 by the supporting parts 18 and 20. In addition both sides of the upper surface 10*a* are supported as far as the front end of the board 10. Conductive pads 34 (described later, see FIG. 8) are disposed on the exposed upper surface and undersurface of the front end portion of the board 10.

Referring to FIG. 7, the end portion 28 of the cable 70 is disposed inside the protruding part 26 located on the rear part of the connector 1. Electrical wires 88 of the small diameter cables 80 exposed beyond the end portion 28 of the cable 70 and are connected by soldering, etc., to conductor pads (not shown in the figures) disposed on the rear end of the board 10. The outer coverings 80*a* and aluminum foil 80*b* of the small diameter cables 80 are omitted from FIG. 7. The signal conductors 82*a* and 84*a* are exposed at the tip ends of the electrical wires 88, and these signal conductors 82*a* and 84*a*, as well as the ground lines 86, are connected to the conductor pads. For purposes of description, only two electrical wires 88 are shown in a twisted state in FIG. 7; in actuality, however, a plurality of electrical wires 88 in which three wires constitute a unit are disposed inside the shell 6 and connected to the board 10.

The braided wire 74 positioned inside the cable 70 is stripped from the tip end of the outer covering 72, and is folded back onto the end portion 28 of the cable 70 and disposed inside the rear part 30 of the shell 6. A metal ferrule 32 is fit over the outside of the rear part 30 of the shell 6 and the outside of the end portion 28 of the cable 70. As a result of this ferrule 32 being pressed and press-bonded, and the shell 6 and braided wire 74 are electrically connected to each other.

Figure 8:
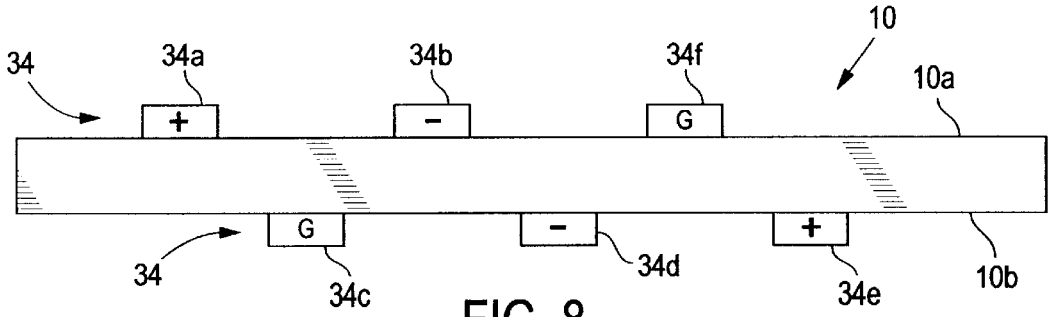
FIG. 8 is an enlarged front view which shows a partial view of the board on which conductor pads are alternately disposed at specified intervals.

The conductor pads 34 are alternately disposed on both sides of the board 10 along the direction of length of the board 10, as is shown in FIG. 8. The conductor pads are connected to the electrical wires 88. The width of the pads 34 is set at a width that allows impedance matching to be accomplished. In order to facilitate the termination of the electrical wires 88 and the mating to the mating connector, it is desirable that the width of the pads 34 at both ends with respect to the direction of length be greater than the width of the pads 34 between the ends; however, for purposes of impedance matching, it is desirable that the length of the pads 34 of a specified width be as long as possible. Alternatively, the pads 34 may be formed as an integral unit with the same width along the direction of length. The polarity of these conductor pads 34 may be described as follows: for example, assuming that the conductor pad 34*a* positioned furthest to the left in FIG. 8 transmits a positive differential signal, and that the conductor pad 34*b* transmits a negative differential signal, then conductor pads 34 that have these polarities are disposed on the same upper surface 10*a*. The ground pad 34*c* is disposed on the surface 10*b* located on the opposite side. The ground pad 34*c* is positioned at an intermediate point between the conductor pads 34*a* and 34*b*. The signal conductors 82*a* and 84*a* and ground line 86 of one set of the aforementioned electrical wires 88 are correspondingly connected to the respective conductor pads 34*a* through 34*c*. In order to aid visual understanding, the symbols + (positive), − (negative) and G (ground) are shown near the conductor pads 34 in FIG. 8.

In another adjacent set of pads 34*d*, 34*e* and 34*f*, the signal pads 34*d* and 34*e* are disposed on the same side as the ground pad 34*c* of the aforementioned set. In this case, the pad 34*d* that transmits a negative differential signal is disposed on the side closer to the pad 34*b* of the previous set, which transmits the same negative differential signal. The ground pad 34*f* is disposed on the opposite side from the pads 34*d* and 34*e*. This is done in order to position pads 34 that have the same polarity in close proximity to each other, so that the detrimental effects of the signal on each other can be avoided. Specifically, the delay or deformation of the rise of signal pulses that rise in the same direction is prevented. The pad of a third set (not shown in the figures) that is adjacent to the pad 34*e* that transmits a positive differential signal is also a pad that transmits the same positive differential signal. Accordingly, the pad 34*e* that transmits a positive differential signal is also protected from being subjected to effects from adjacent pads. Thus, the electrical wires 88 of respective adjacent units are connected to the conductor pads 34 so that the same polarities (same phases) are adjacent to each other between the respective units. As a result, crosstalk can be prevented.

Figure 9:
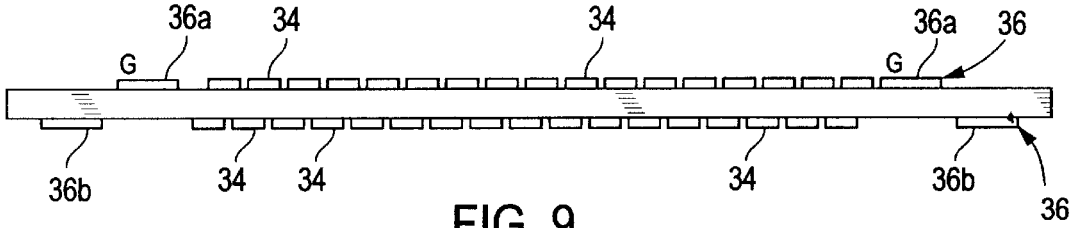
FIG. 9 is a front view of the board as a whole.

In the board 10 shown in FIG. 9, power supply conductor pads 36 are disposed on both sides at both ends of the board 10. In the case of this working configuration, there are two power supply systems; accordingly, two power supply conductor pads are disposed at each end to the outside of the rows of pads 34. In the embodiment shown, the power supply ground pads 36*a* are disposed closer to the pads 34. The pads 36*b* on the side of the active lines of the power supplies are disposed on the surface located on the opposite side from the ground pads 36*a*, and are disposed further away from the pads 34. As a result, the effect received by the pads 34 from the power supply pads 36 is reduced, and there is a reduced danger of noise invading the pads 34 used for the signal lines 82 and 84 from the power supply. To aid visual understanding, the symbol G is shown in the vicinity of the ground conductor pads 36*a* in FIG. 9.

Figure 10:
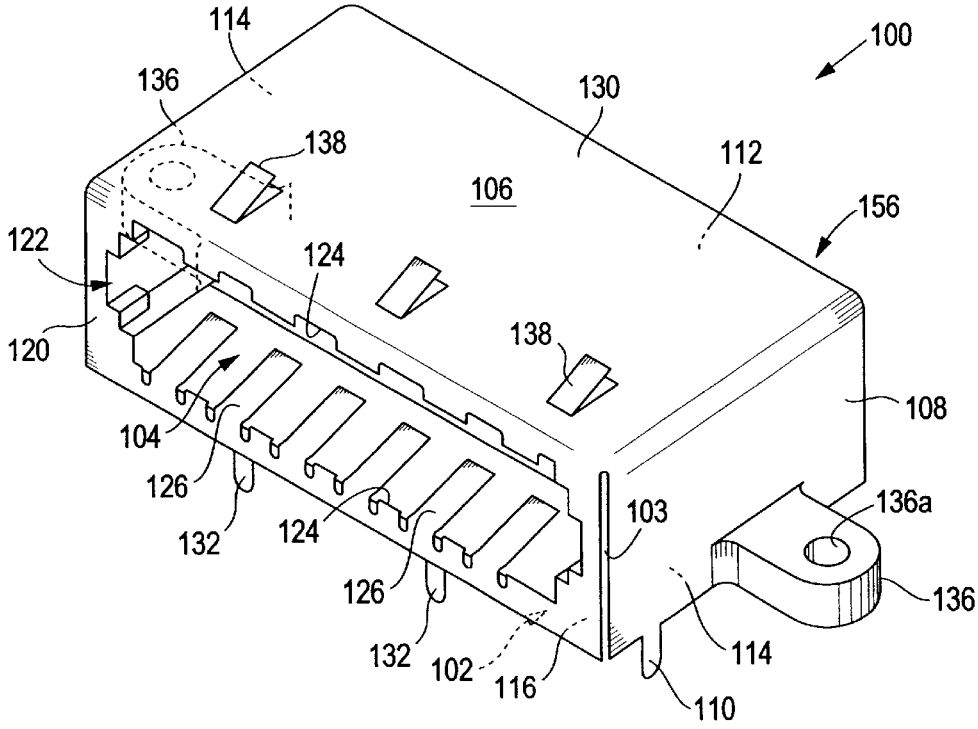
FIG. 10 is a perspective view of a mating connector.
Figure 11:
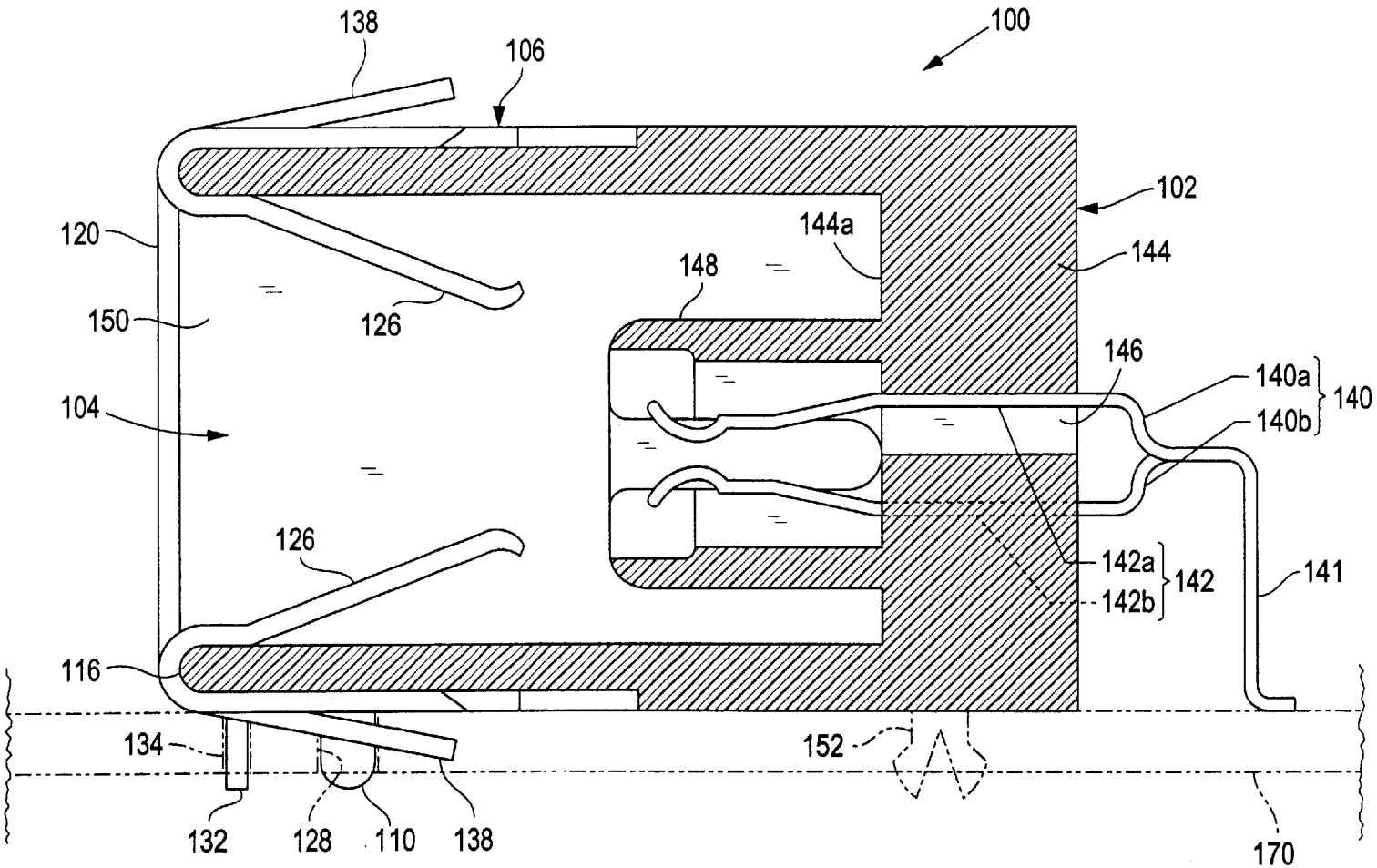
FIG. 11 is a longitudinal sectional view of the mating connector shown in FIG. 10.

Referring to FIGS. 10 and 11, the mating female connector 100 which mates with connector 1 is shown. Connector 100 has an insulating housing 102 that has an engaging recess 104, and a shielding shell 106 that is mounted on the outside of the housing 102. The shell 106 is formed by stamping and bending a single metal plate, and has a main body 156 that covers the top wall 112 and side walls 114 of the housing 102, and a face plate 120 that covers the front surface 116 of the housing 102. The face plate 120 that covers the front surface 116 of the housing 102 is separated from each side wall 108 by a space or gap 103.

An opening 122 corresponding to the aforementioned engaging recess 104 is formed inside the face place 120. Spring contact parts 126 are formed by being bent from the upper and lower inside edges 124 of the opening 122 at specified intervals such that the spring contact parts 126 enter the interior of the engaging recess 104. When the connector 1 and mating connector 100 are mated together, the spring contact parts 126 engage the shell 6 of the connector 1, so that a continuous grounding path is provided and both connectors are grounded. In the embodiment shown, connector 100 is fastened to an attachment board 170, which is indicated by a dotted line in FIG. 11. Generally, the grounding connection to ground conductors (not shown in the figures) in the attachment board 170 is accomplished by means of tongue parts 110 that extend downward from the respective side walls 108 of the shielding shell 106. Specifically, the tongue parts 110 are generally disposed inside corresponding openings 128 in the attachment board 170, and are soldered to ground conductors (not shown in the figures) that communicate with these openings 128, thereby providing a reliable electrical connection therebetween. In other words, the shielding shell 106 is used as a reference.

As is evident from the figures, the length of the path extending to the tongue parts 110 used for grounding differs between the spring contact parts 126 on the upper side of the face plate 120 and the spring contact parts 126 on the lower side of the face plate 120. Specifically, from the upper-side spring contact parts 126, the electrical path that is followed extends from the top wall 130 of the shell 106 to the tongue parts 110 via the side walls 108. However, in the case of the lower-side spring contact parts 126, the electrical path that is followed travels around the periphery of the face plate 120 and reaches the top wall 130 via parts with a narrow width, and then extends to the tongue parts 110 via the side walls 108. As a result, the length of the path from the lower-side spring contact parts 126 is increased, so that the grounding path forms a large loop. This increases the impedance, and thereby increases the noise picked up. Consequently, there is a danger that the differential transmission function will be hindered, resulting in a drop in the transmission quality and a drop in the noise resistance.

Accordingly, tongue parts 132, similar to the tongue parts 110, used only by the face plate 120 are cut and formed in two places which are separated by an interval on the lower side of the face plate 120. The tongue parts 132 are inserted into openings 134 (see FIG. 11) in the attachment board 170, so that a ground connection is established via the shortest path. As a result, no great difference is generated in the transmission paths.

The attachment of the connector 100 to the attachment board 170 is accomplished by means of attachment tabs 136 that protrude from the side walls 114 of the housing 102 in two places (FIG. 10). Specifically, fastening is accomplished by the fastening of screws (not shown in the figures) that are passed through through-holes 136*a* formed in the attachment tabs 136. Alternatively, in cases where screw fastening is not used, it would also be possible to install retention legs 152 (indicated in phantom in FIG. 11) on the shell 106, and to fasten the connector 100 to the attachment board 170 by means of these retention legs 152.

A plurality of contact parts 138, which are cut and raised from the top wall 130, are formed along the engaging part on the front end portion of the top wall 130 of the shell 106. The contact part are used when the engaging part of the connector 100 is pressed into an attachment panel (not shown in the figures), and a grounding connection is made with the attachment panel by the front part of the connector 100. Similar contact parts 138 are also formed on the lower side of the shell 106 as shown in FIG. 11 for the same purpose. In cases where the connector 100 is grounded to the attachment board 170 using the tongue parts 132, these contact parts 138 are not required.

Contacts 140 of connector 100 consist of two types of contacts 140*a* and 140*b* in which the tine parts 141 have the same shape, i.e., contacts 140*a* in which a contact arm 142 is bent upward from the tine part 141, and contacts 140*b* in which this contact arm 142 is bent downward from the tine part 141. The contact arms 142*a* of the contacts 140*a* and the contact arms 142*b* of the contacts 140*b* have symmetrical shapes, and are bent so that respective contacts face each other to form contact sections which engage pads 34, 36 when mating occurs. The tip ends of these contact arms 142*a* and 142*b* are bent to the outside to act as lead in surface when the connectors 1 and 100 are mated together.

Contacts 140 are inserted into the mating connector 100 by pushing the contacts from the back side of the housing 102 into contact insertion holes 146 alternately formed in the rear wall 144 of the housing 102. The contacts are anchored by press-fitting in the housing 102. A covering wall 148 which projects from the inside surface 144*a* of the rear wall 144 is provided to protect the contacts 140 has mating occurs. The covering wall 148 protrudes toward the front of the connector 100, i.e., toward the engaging part 150. Since the electrical signals that pass through the symmetrical contacts 140*a* and 140*b* pass through tine parts 141 that have the same shape, no difference (skewing) is generated in the transmission rate of the electrical signals. Accordingly, transmission quality and anti-noise characteristics are maintained.

Figure 12:
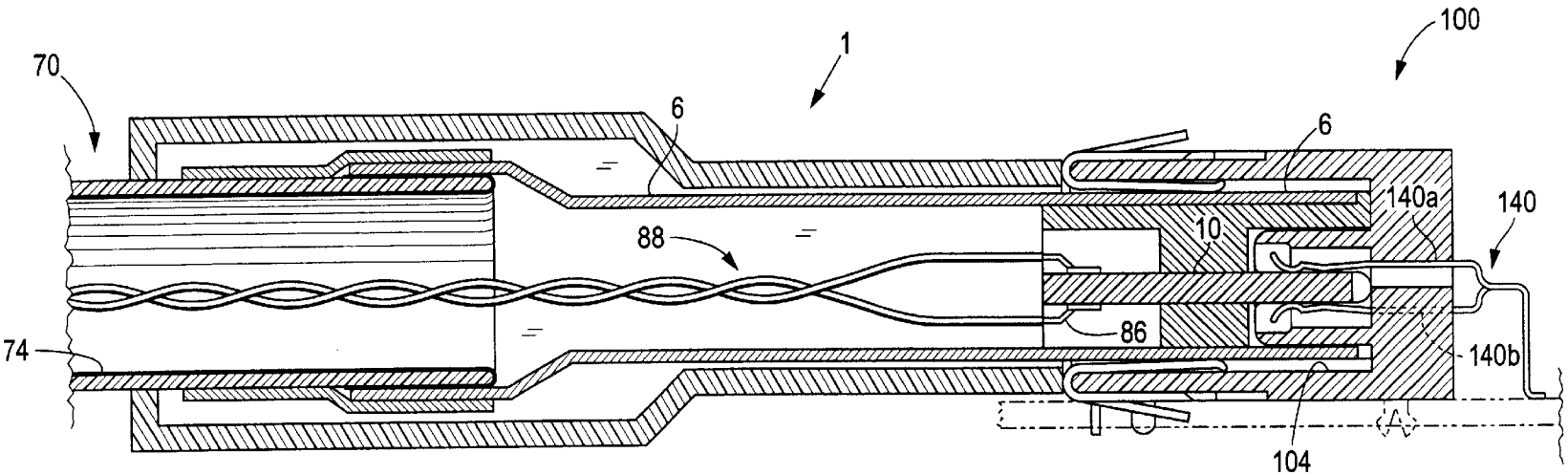
FIG. 12 is a sectional view showing the electrical connector assembly of the present invention in engagement with the mating connector.
Figure 13:
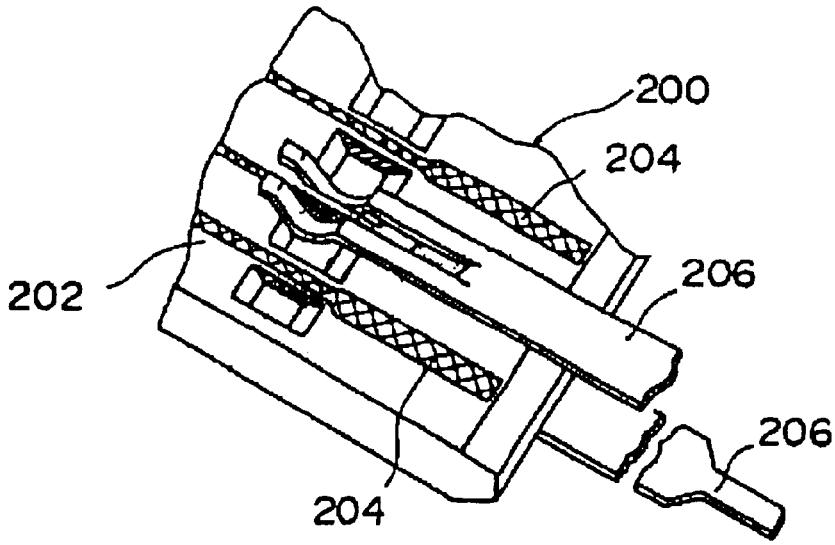
FIG. 13 is a perspective view of a prior art connector.

Referring to FIG. 12, when the connectors are engaged with each other, the shell 6 of the connector 1 advances into the engaging recess 104 of the connector 100, so that the shell 6 and the spring contact parts 126 of the shell 106 are grounded to each other. Furthermore, the board 10 advances into the spaces between the contact arms 140*a* and 140*b* of the contacts 140, so that the pads 34 and 36 and contacts 140 are electrically connected to each other. In this case, a ground path is continuously formed from the braided wire 74 of the cable 70 of the connector 1 through the shell 6 and the shell 106 of the connector 100, and then to the attachment board 170, so that the ground path is formed as a frame ground. Furthermore, ground paths that are connected to the contacts 140 from the ground lines 86 of the electrical wires 88 via the board 10 form signal grounds. High-speed transmission can be handled by separating the ground paths in this manner.

In the connector 100 described above, the ground path does not form a large loop, so that the inductance of the ground path can be reduced, thus making it possible to improve the noise resistance.

What is claimed is:

1. An electrical connector assembly comprising:

a housing;

a planar insulating body which cooperates with the housing, the insulating body having a plurality of conductor pads formed on both sides thereof which are provided in electrical engagement with a plurality of cables;

the cables each have a positive signal line and a negative signal line used for differential transmission, and a ground line;

the positive signal line and negative signal line of each cable are connected to adjacent signal conductor pads on one side of the insulating body, while the ground line of each cable is connected to a ground conductor pad on an opposed side of the insulating body, the ground conductor pad is located in an intermediate position between the adjacent signal conductor pads to which the positive signal line and negative signal line are connected; and the signal conductor pads are disposed so that the signal conductor pad to which the positive signal line or negative signal line of each cable is connected is located in closest proximity to another conductor pad connected to a signal line having a same polarity, thereby reducing the amount of interference between respective cables.

2. The electrical connector assembly as recited in claim 1 wherein the conductor pads in electrical contact with a second respective positive signal line and a second respective negative signal line are provided on the opposed side of the insulating body and a second respective ground line is provided on the one side of the insulating body.

3. The electrical connector assembly as recited in claim 1 wherein power supply conductor pads are disposed to an outside of rows of the signal conductor pads of the insulating body, thereby reducing noise received by the signal conductor pads from the power supply conductor pads.

4. The electrical connector assembly as recited in claim 1 wherein the signal conductor pads and the ground conductor pads are configured to allow for impedance matching.

5. The electrical connector assembly as recited in claim 1 further comprising a mating electrical connector positioned in electrical engagement with the housing, the mating electrical connector has a mating shielding shell which has spring contact parts which extends therefrom and make contact with a connector shielding shell provided about the housing.

6. The electrical connector assembly as recited in claim 5 wherein upper spring contact parts engage an upper portion of the connector shielding shell and lower spring contact parts engage a lower portion of the connector shielding shell, first and second tabs extend from the mating shielding shell, the first tabs being in electrical communication with the upper spring contact parts and the second tabs being in electrical communication with the lower spring contact parts, whereby a short electrical path is provided.

* * * * *